US005946778A

United States Patent [19]

McGarity

[11] Patent Number: 5,946,778

[45] Date of Patent: Sep. 7, 1999

[54] CLIP WITH RETRACTABLE OPERATING LEVERS

[76] Inventor: Ronald M. McGarity, 150 Interlochen Dr., Peachtree City, Ga. 30269

[21] Appl. No.: 09/131,769

[22] Filed: Aug. 11, 1998

[51] Int. Cl.[6] ..... B42F 1/00

[52] U.S. Cl. ..... 24/536; 24/67.5; 24/558

[58] Field of Search ..... 24/530, 535, 536, 24/330, 331, 67.3, 67.5, 67.9, 557, 558, 494, 495, 496, 545, 565, 502, 508, 511

[56] References Cited

U.S. PATENT DOCUMENTS

| | | | |
|---|---|---|---|
| 467,244 | 1/1892 | Ballard | 24/558 |
| 1,965,554 | 7/1934 | Mainwaring | 24/67.5 |
| 2,259,505 | 10/1941 | Wisdom | 24/558 X |

FOREIGN PATENT DOCUMENTS

| | | | |
|---|---|---|---|
| 868055 | 12/1941 | France | 24/67.5 |

*Primary Examiner*—James R. Brittain

*Assistant Examiner*—Robert J. Sandy

*Attorney, Agent, or Firm*—James B. Middleton; Walter A. Rodgers

[57] ABSTRACT

A spring clip has jaws connected by a throat that provides spring action to urge the jaws together, and levers on each jaw that can be extended to provide a mechanical advantage for opening the jaws, or can be retracted so the levers are juxtaposed on the jaws. The jaws have bosses thereon, and openings are defined in the bosses for receiving the levers. The openings have tongues along their sides, and the levers define grooves along their sides so the levers can slide smoothly into and out of the opening. Detents provide stops at retracted and extended positions of the levers, and a screw riding in a slot provides a positive stop to prevent inadvertent removal of the lever.

5 Claims, 3 Drawing Sheets

CLIP WITH RETRACTABLE OPERATING LEVERS

BACKGROUND OF THE INVENTION

1. Field of the Invention

This invention relates generally to clips and the like, and is more particularly concerned with an aesthetically designed clip having selectively retractable and extendible operating levers.

2. Discussion of the Prior Art

Clips for use in many areas, for holding a great variety of items, are well known in the art. Such clips generally comprise a pair of spring urged jaws that are normally urged towards each other, and operating levers for selectively opening the jaws for insertion of material to be held therebetween.

It is frequently desirable to leave a clip in place for an extended period of time. Because of this, the operating levers can be a nuisance. The operating levers protrude outwardly and prevent neat stacking of papers, scratch furniture, catch on the materials being held or other clips, and generally are undesirable. As a result, many clips have been devised wherein the operating levers can be disposed against the body of the clip to be out of the way during use. The operating levers usually pivot to lie along the body of the clip, or may hinge to lie over the materials being held.

Some forms of clips have not had operating levers, such as money clips of the type used to clip paper currency together, paper clips and the like. Such clips are normally simply spring clips, perhaps with a rampway to assist in sliding the clip onto the material to be held. While operating levers would make the use of spring clips easier, the prior art clips have not been aesthetically pleasing, and the operating levers may interfere with various things and be more of a nuisance than a help.

SUMMARY OF THE INVENTION

The present invention provides a spring urged clip having generally flat jaws and a resilient throat for urging the jaws together. Operating levers are carried by the jaws for selectively forcing the jaws apart, and the operating levers are selectively disposable in a retracted position juxtaposed on the body of the clip, and an extended position extending from the jaws for providing a mechanical advantage for opening the jaws of the clip. The levers preferably slide in tracks to give the clip an integral appearance when the levers are retracted, and detents are provided at the retracted and extended positions. The clip of the present invention may find application in any field, for clipping virtually any material.

The clip of the present invention can be made inexpensively, perhaps of a polymeric material or an inexpensive metal, or can be made of more expensive metals, and may even include plating of precious metal and decoration with gem stones. The clip may have very strong spring force for holding things together, or may have a weak spring force to hold money, a few papers or the like. Thus, the clip of the present invention may be a purely utilitarian device usable in any field, or may be a piece of fine jewelry.

BRIEF DESCRIPTION OF THE DRAWINGS

These and other features and advantages of the present invention will become apparent from the following specification when taken in conjunction with the accompanying drawings in which.

DETAILED DESCRIPTION OF THE EMBODIMENT

Figure 1:
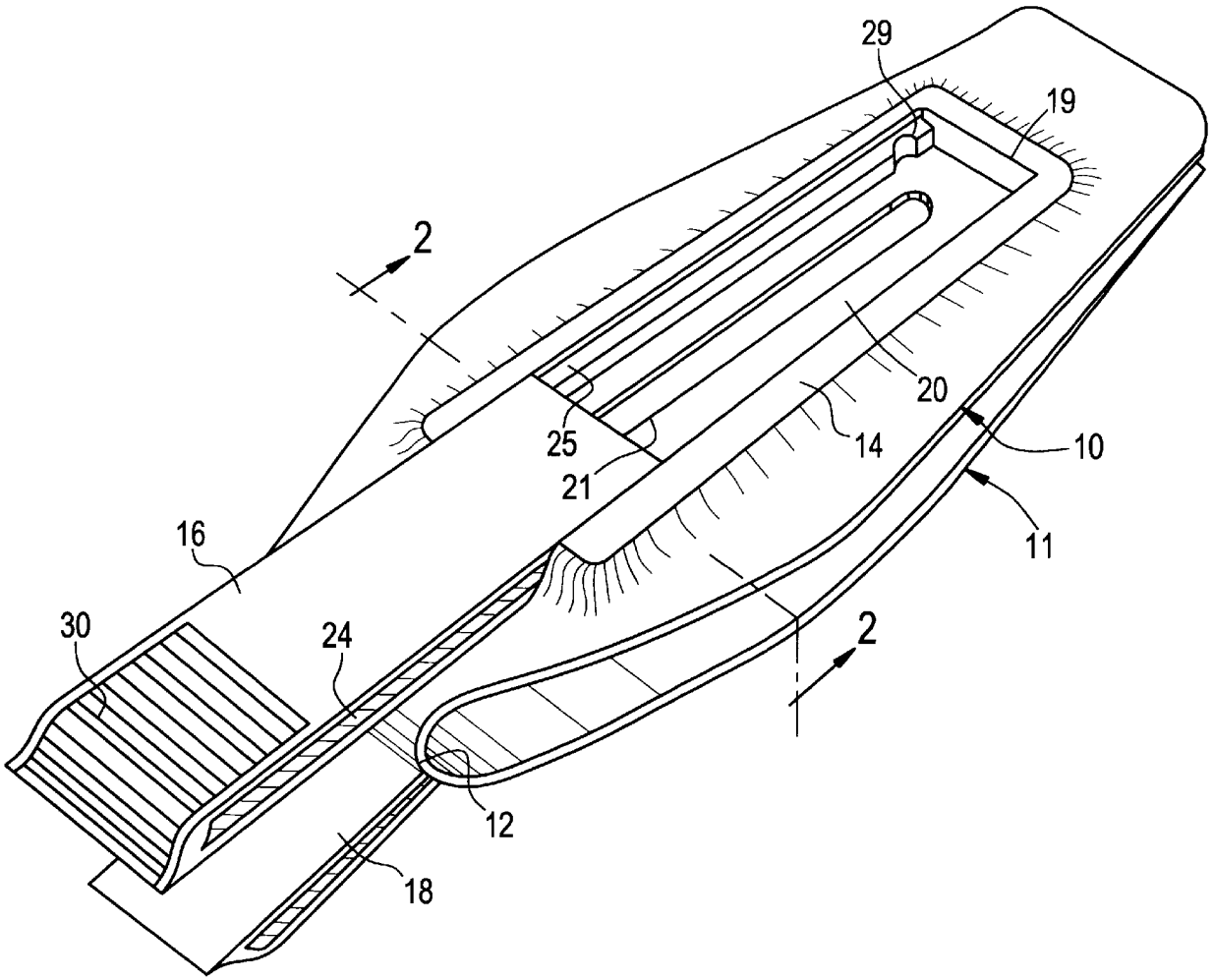
FIG. 1 is a perspective view of a clip embodying the present invention.

Referring now more particularly to the drawings, and to that embodiment of the invention here presented by way of illustration, FIG. 1 shows a clip made in accordance with the present invention and including upper and lower jaws 10 and 11 joined by a throat 12. As here shown, it is contemplated that the clip will be used as a money clip to be carried in a person's pocket. Those skilled in the art, however, will realize that this particular use is illustrative only, and the invention is equally applicable to many styles of clips for many different uses. Nevertheless, this one embodiment will be presented in the following discussion.

Each of the jaws 10 and 11 has a generally rectangular boss thereon, the bosses being designated 14 and 15 respectively; and, each boss 14 and 15 has a slide 16 and 18 that is selectively extendible and retractable to act as an operating lever for the clip. As shown in FIG. 1 of the drawings, the slides 16 and 18 are extended. It will be noted that the slide 16 is sufficiently engaged with the boss 14 that a force can be exerted on the jaw 10, as will be discussed in more detail hereinafter.

Figure 2:
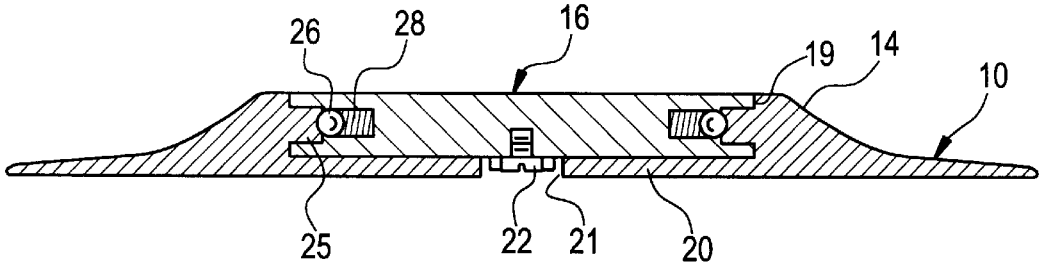
FIG. 2 is a cross-sectional view taken along the line 2—2 in FIG. 1.

Looking at FIG. 1 in more detail, and considering FIG. 2, it will be seen that the boss 14 defines an opening 19 for receiving the slide 16, the opening 19 having a floor 20. The floor 20 defines a slot 21 therein for providing access to the bottom of the slide 16. The slot 21 allows installation of the retaining screw 22.

The slide 16 engages the boss 14 with a tongue and groove as is best seen in FIG. 2. The slide 16 defines a groove 24 therein, and the sides of the opening 19 are provided with tongues 25. Interengagement of the tongue with the groove provides a good mechanical connection that will allow the slide, or operating lever, to open the clip, yet allow easy extension and retraction of the lever.

It should be noticed that, when the levers, or slides, 16 and 18 are fully retracted, the lever is coincident with the boss 14. This arrangement provides a smooth and elegant appearance of the clip, and also nestles the levers such that there is no projecting portion to catch fabric, or other things one might be carrying in a pocket with the money clip. Thus, when the levers are retracted, it is desirable that they stay retracted until they are intentionally extended. Detents are provided to hold the levers 16 and 18 in their fully retracted position, and in their fully extended position. As can be seen in FIG. 2, the detents include balls 26 urged by springs 28 into recesses 29. Those skilled in the art will understand that the recesses will be shaped, and of such depth, as may be determined to provide the desired difficulty in moving the slide away from the detent. As will be discussed later, there are detents at both the fully retracted and the fully extended positions.

Figure 3:
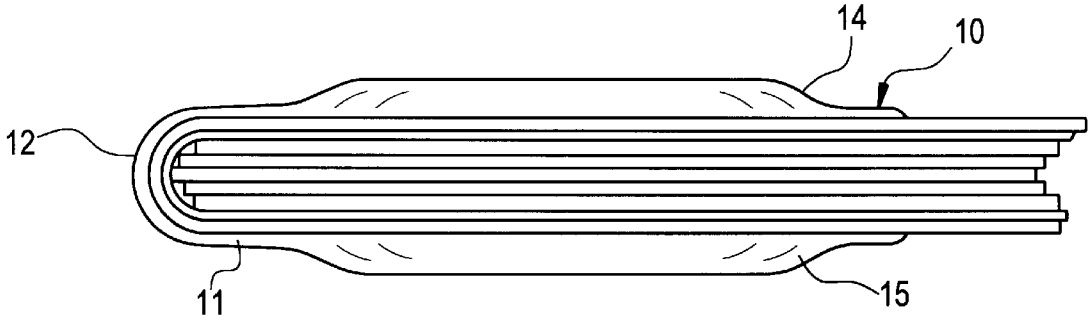
FIG. 3 is a side elevational view of the clip of FIG. 1, with a stack of papers or the like between the jaws of the clip; and, FIG. 4 is an enlarged, top plan view of the clip of FIG. 1, portions thereof being broken away to show the construction.

In using a money clip, many people carry currency folded around credit cards, drivers license and other similar cards. This arrangement is shown in FIG. 3 of the drawings, which is a side elevational view of a clip made in accordance with the present invention, and having currency and cards held therein. In FIG. 3, the levers 16 and 18 are retracted, so the jaws 10 and 11 with their bosses 14 and 15 are shown, and the levers are not separately visible.

Figure 4:
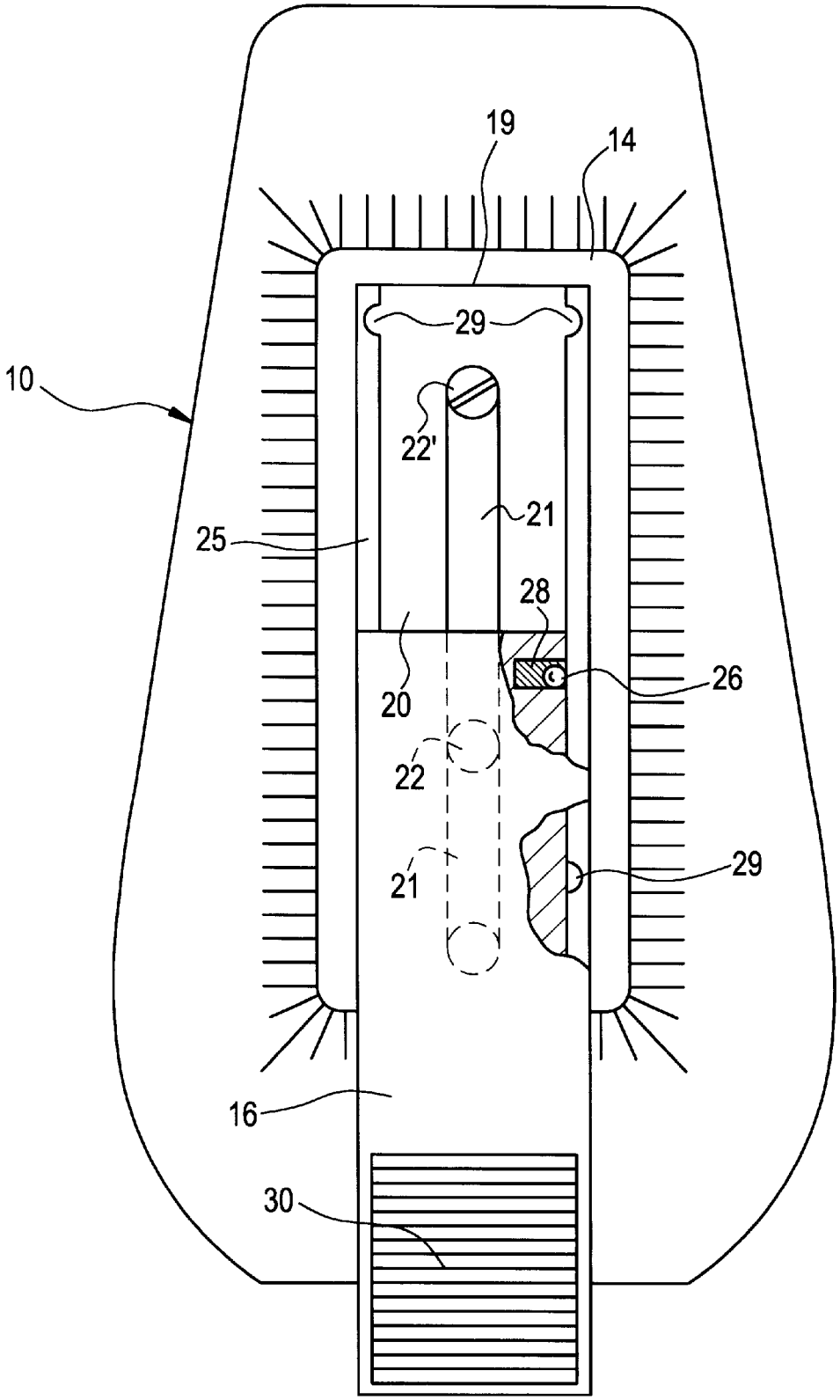

For a better understanding of the operation of the clip of the present invention, attention is directed to FIG. 4 of the drawings. In FIG. 4 the upper lever 16 is partially slid back to expose the floor 20 of the opening 19 with its slot 21. Through the slot 21 can be seen a screw head 22', which acts as the stop for the lever 18. It will be understood that the levers 16 and 18 are constructed alike, but as mirror images of each other, so only one lever will be described in detail.

The continuation of the slot 21 is shown in phantom, and it will be seen that the slot extends to the rear of the boss 14. The screw 22 is also shown in phantom, and it will be understood that the screw will abut the end of the slot 21 and not allow further movement of the lever. For assembly, and disassembly when required, the screw can be reached from the opposite side, as with the screw 22' shown in FIG. 4.

For ease in use of the clip of the present invention, it is desirable to have the levers 16 and 18 stay in the selected position, whether extended or retracted. The detents are well shown in FIG. 4, and it can be seen that there is a recess 29 at the forward end of the boss, the recess 29 being defined in the tongue 25. With the spring urged ball detent adjacent to the forward end of the lever 16, the lever will tend to stay closed when slid all the way forward. Also, there is a recess 29 adjacent to the opposite end of the tongue, so the detent 26 will hold the lever in its rearward position. To assist in moving the lever between the two positions, the levers 16 and 18 have a fluted surface 30. Obviously other arrangements could also be used, such as knurling, rubber inserts, or the use of other expedients known to those skilled in the art, so long as there is an increased frictional force to facilitate moving of the levers. Additionally it will be understood that the balls 26 will ride along the tongues 25 as the slides 16 and 18 are extended or retracted, and the spring-urged balls 26 will allow easy movement while preventing any looseness, or play, in the slides as they move.

In view of the foregoing discussion, it will be understood that the present invention provides a clip for use in virtually any area, though the embodiment shown is a money clip or the like. The clip has levers that are retractable to be juxtaposed on the body of the clip for a neat and trim appearance. Looking at FIGS. 1 and 3, it will be seen that, when the slides 16 and 18 are fully retracted and juxtaposed on the body of the clip, the fluted end 30 forms the rear end of the boss 14, the slide being fully nested within the opening 19 of the boss 14. When desired, the levers can easily be extended to be used to provide a mechanical advantage for opening the clip to hold or release money, cards or other material. The detents provide stops that are easily overcome for easy operation of the device, and the screws 22 and 22' provide definite stops so the levers will not be inadvertently removed.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit of scope of the invention as outlined in the appended claims.

What is claimed as invention is:

1. A clip comprising a pair of jaws, spring means for urging said jaws towards each other, lever means comprising a pair of levers for providing a mechanical advantage for urging said jaws apart, said lever means being slidably retractable and extendible to be selectively juxtaposed with respect to said pair of jaws, each jaw of said pair of jaws defining an elongated opening therein, and each lever of said pair of levers being selectively receivable within one of said elongated openings and extendible for opening said clip.

2. A clip as claimed in claim 1, and further including at least one detent for temporarily holding at least one of said pair of levers in a predetermined position.

3. A clip as claimed in claim 2, each jaw of said pair of jaws including a boss thereon, said opening being defined in said boss, and a throat connecting said jaws and providing said spring means for urging said jaws towards each other.

4. A clip as claimed in claim 3, wherein said elongated opening includes a floor defining a slot parallel to said lever, and stop means fixed to said lever and riding in said slot for limiting the extending movement of said lever.

5. A clip as claimed in claim 4, said elongated opening further including tongues on each side thereof, said lever defining grooves on each side thereof for receiving said tongues, so that said lever can slide as said grooves slide along said tongues.

* * * * *